US010898786B2

(12) United States Patent
Liniado

(10) Patent No.: US 10,898,786 B2
(45) Date of Patent: Jan. 26, 2021

(54) CONVERTIBLE SPORT BOARD SYSTEM

(71) Applicant: DGL Group, Edison, NJ (US)

(72) Inventor: Marc Liniado, Brooklyn, NY (US)

(73) Assignee: DGL GROUP LTD., Edison, NJ (US)

( * ) Notice: Subject to any disclaimer, the term of this patent is extended or adjusted under 35 U.S.C. 154(b) by 0 days.

(21) Appl. No.: 16/452,887

(22) Filed: Jun. 26, 2019

(65) Prior Publication Data

US 2020/0346100 A1 Nov. 5, 2020

Related U.S. Application Data

(60) Provisional application No. 62/842,214, filed on May 2, 2019.

(51) Int. Cl.
*A63C 17/26* (2006.01)
*A63C 17/01* (2006.01)

(52) U.S. Cl.
CPC ..... *A63C 17/265* (2013.01); *A63C 17/014* (2013.01); *A63C 2203/42* (2013.01)

(58) Field of Classification Search
CPC ..... A63C 17/265; A63C 17/042
See application file for complete search history.

(56) References Cited

U.S. PATENT DOCUMENTS

| | | | | | |
|---|---|---|---|---|---|
| 4,775,162 | A * | 10/1988 | Chao | A63C 17/01 | 280/267 |
| D304,210 | S * | 10/1989 | Fonte | D21/423 | |
| 6,158,751 | A * | 12/2000 | Wu | B62K 3/002 | 280/87.041 |
| 9,339,677 | B2 | 5/2016 | Kramer et al. | | |
| 9,364,716 | B2 | 6/2016 | Kramer et al. | | |
| 9,616,294 | B2 | 4/2017 | Kramer et al. | | |
| 9,950,244 | B1 * | 4/2018 | Sargis | A63C 17/12 | |
| 10,010,759 | B2 | 7/2018 | Kramer et al. | | |
| 10,052,520 | B2 | 8/2018 | Kramer et al. | | |
| 10,245,937 | B2 * | 4/2019 | Gillett | G05D 1/0278 | |
| 2002/0093162 | A1 * | 7/2002 | Tai | B62K 15/006 | 280/87.041 |
| 2005/0230929 | A1 * | 10/2005 | Chen | B62K 13/00 | 280/87.05 |
| 2015/0202526 | A1 * | 7/2015 | Rawlins | A63C 17/0093 | 280/87.042 |
| 2016/0256746 | A1 | 9/2016 | Kramer et al. | | |

* cited by examiner

*Primary Examiner* — John D Walters
*Assistant Examiner* — James J Triggs
(74) *Attorney, Agent, or Firm* — Myers Wolin, LLC

(57) ABSTRACT

A sport board system is provided, the system having a sport board deck having a bottom surface, a front end and a rear end, a rear wheel assembly fixed to the bottom surface adjacent the rear end, and a fixation structure for a wheel assembly at the front end. The fixation structure has a notch passing through a thickness of the sport board deck, fixation rails parallel to a length of the sport board deck, and a locking mechanism at an end of the notch. Also provided is a method for transforming a sport board system from a skateboard configuration to a scooter configuration.

14 Claims, 9 Drawing Sheets

CONVERTIBLE SPORT BOARD SYSTEM

CROSS REFERENCE TO RELATED APPLICATIONS

This application claims the benefit of provisional application U.S. 62/842,214, filed on May 2, 2019, the entire contents of which are incorporated herein by reference.

FIELD OF THE INVENTION

This disclosure relates to a convertible sport board system that has skateboard and scooter configurations, and in particular, a sport board system having an interchangeable wheel assembly.

BACKGROUND

High quality skateboards and scooters can be expensive, and consumers often desire both products. There is a need for a sport board that can function as both a high quality skateboard and a high quality scooter. There is a further need for such a sport board that can provide motorized propulsion in the form of both a skateboard and a scooter.

SUMMARY

A sport board system is provided, the system having a sport board deck having a bottom surface, a front end and a rear end, a rear wheel assembly fixed to the bottom surface adjacent the rear end, and a fixation structure for a wheel assembly at the front end. The fixation structure has a notch passing through a thickness of the sport board deck, fixation rails parallel to a length of the sport board deck, and a locking mechanism at an end of the notch.

The sport board system further comprises a skateboard wheel assembly for mating with the fixation structure, the skateboard wheel assembly comprising a plurality of skateboard wheels and a scooter wheel assembly for mating with the fixation structure, the scooter wheel assembly comprising at least one scooter wheel and a handle assembly. In some embodiments, the skateboard wheel assembly comprises two skateboard wheels and the scooter wheel assembly comprises one scooter wheel distinct from the skateboard wheels.

When the scooter wheel assembly is mated with the fixation structure, the wheel extends downwards from the bottom surface of the sport board deck, and the handle assembly extends upwards above a top surface of the sport board deck.

Each of the skateboard wheel assembly and the scooter wheel assembly comprises a mounting rail for mating with the fixation rail of the fixation structure. Further, each of the skateboard wheel assembly and the scooter wheel assembly typically comprise a deck segment containing the mounting rail, where the deck segment is shaped to complete the shape of the sport board deck when mated with the sport board deck by filling the notch of the fixation structure.

In some embodiments, where the length of the sport board deck is defined from the front end of the deck to the rear end of the deck, when the skateboard wheel assembly is mated with the fixation structure, the plurality of skateboard wheels are located under the length of the sport board deck. In contrast, when the scooter wheel assembly is mated with the fixation structure, the wheel of the assembly is located outside of the length of the sport board deck.

In some embodiments, when in the scooter configuration, the handle assembly extends upwards from the scooter wheel assembly outside the length of the sport board deck as well.

In some embodiments, the rear wheel assembly is motorized. In such an embodiment, the skateboard wheel assembly may further comprise a wireless controller for controlling a motor for driving the rear wheel assembly. Further, where the rear wheel assembly is motorized, the handle of the scooter wheel assembly may further comprise a controller for controlling a motor for driving the rear wheel assembly.

The controller may be a single controller that functions wirelessly when in the skateboard configuration and is fixed to the handle in the scooter configuration, or it may be distinct controllers that are paired with the rear wheel assembly in turn. In some embodiments, the first wireless controller may provide the necessary connectivity, and the second controller fixed to the handles of the scooter wheel assembly may connect by way of the first controller.

Typically, where the rear wheel is motorized, the controller will control acceleration and, in some cases, braking of the rear wheel assembly. Further, where the rear wheel assembly is motorized, the sport board system may further comprise a battery located at the bottom surface of the sport board deck.

In some embodiments, the skateboard wheels and the scooter wheels are distinct wheels. For example, the skateboard wheels may each have a wider rolling surface than the at scooter wheel. Further, the skateboard wheel may have a flat surface that contacts the ground, while the scooter wheel may have a rounded surface that contacts the ground.

In some embodiments, the locking mechanism is a locking rocker which mates with a receiving structure of each of the skateboard wheel assembly and the scooter wheel assembly. Further, the locking rocker may comprise a bar and the receiving structure of each of the skateboard wheel assembly and the scooter wheel assembly comprises a notch for receiving the bar.

DETAILED DESCRIPTION OF THE PREFERRED EMBODIMENTS

Figure 1A:
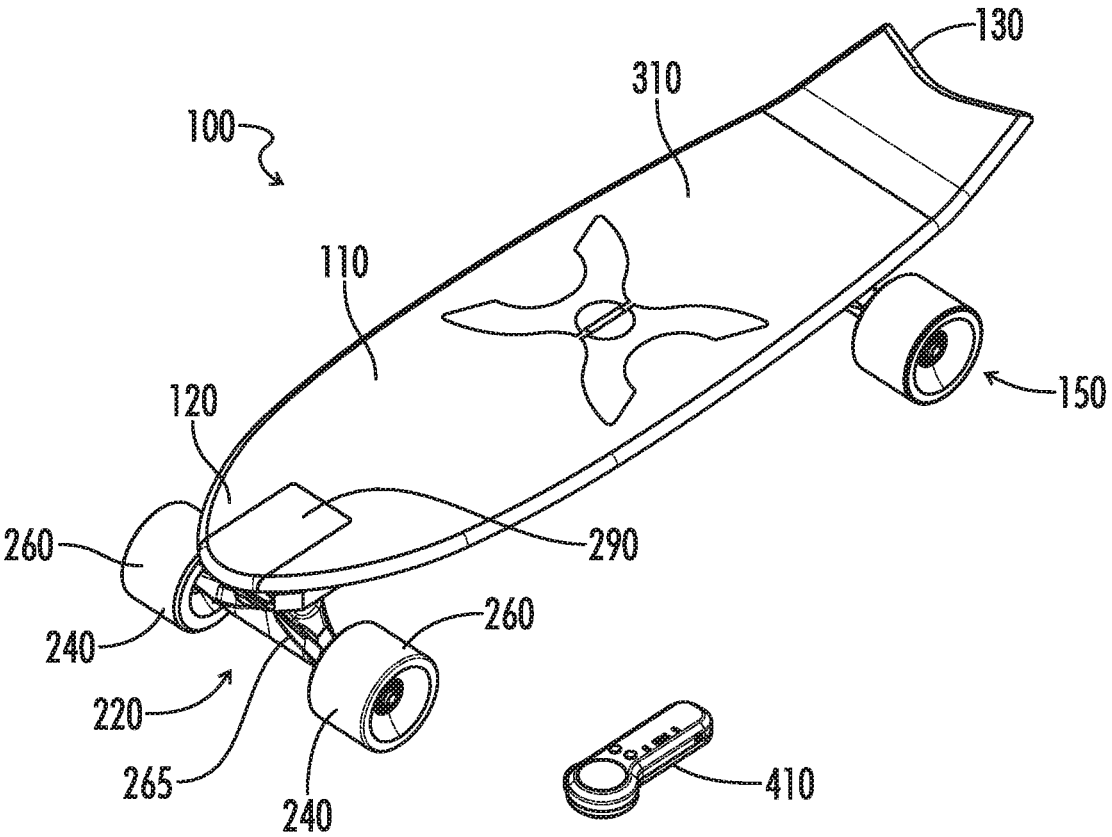
FIGS. 1A and 1B show a front and rear perspective view respectively of a sport board system in a skateboard configuration.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

Figure 1B:
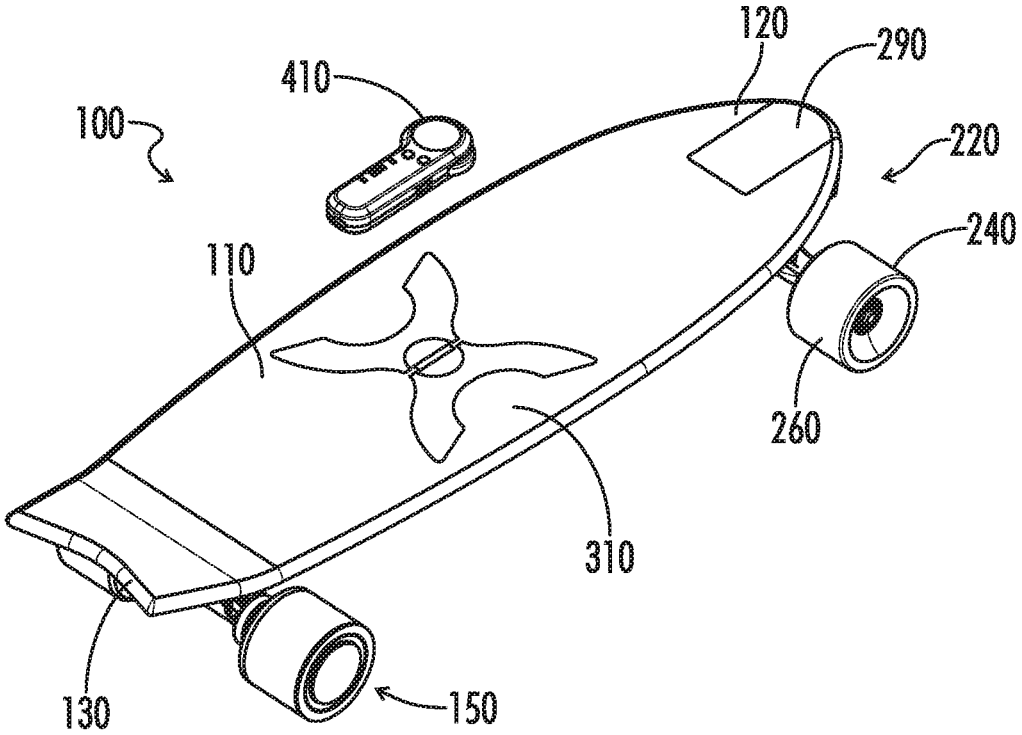
Figure 2A:
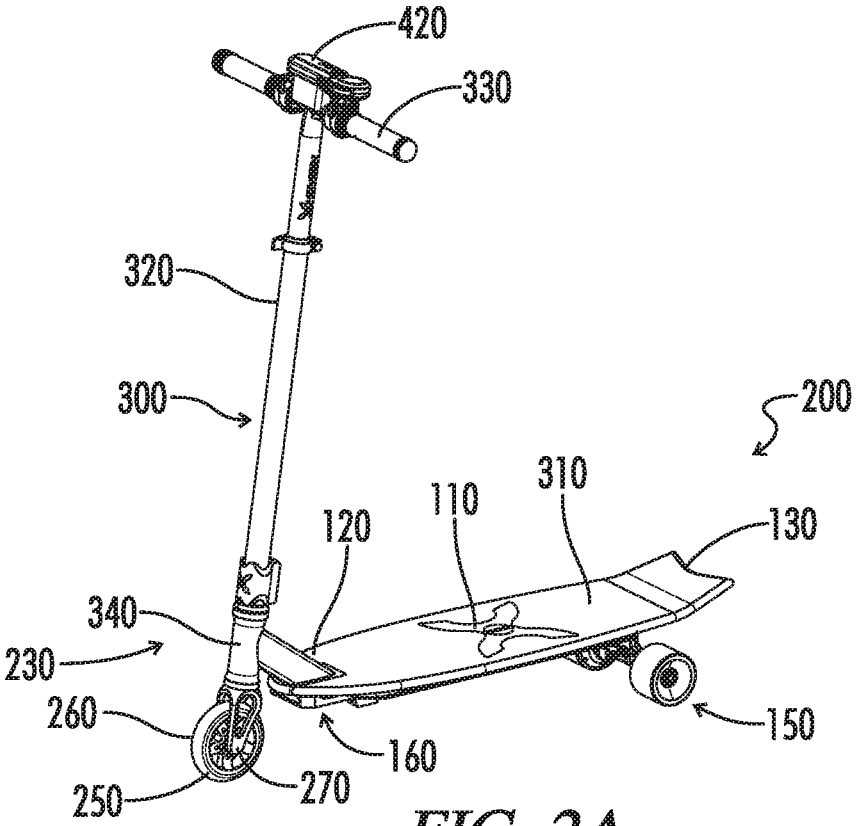
FIGS. 2A and 2B show a left side and right side perspective view respectively of a sport board system in a scooter configuration.
Figure 2B:
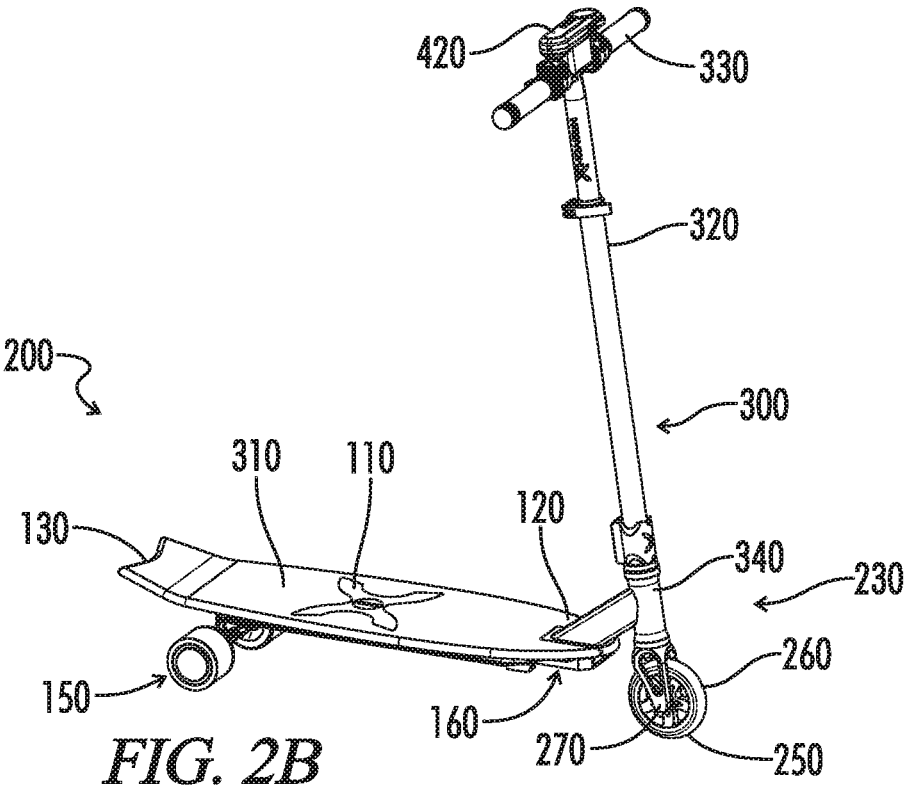

FIGS. 1A and 1B show a front and rear perspective view respectively of a sport board system in a skateboard configuration 100. FIGS. 2A and 2B show a left and right perspective view respectively of a sport board system in a scooter configuration 200. As shown, the system comprises a sport board deck 110, the deck having a bottom surface (not shown), a front end 120, and a rear end 130

Figure 3A:
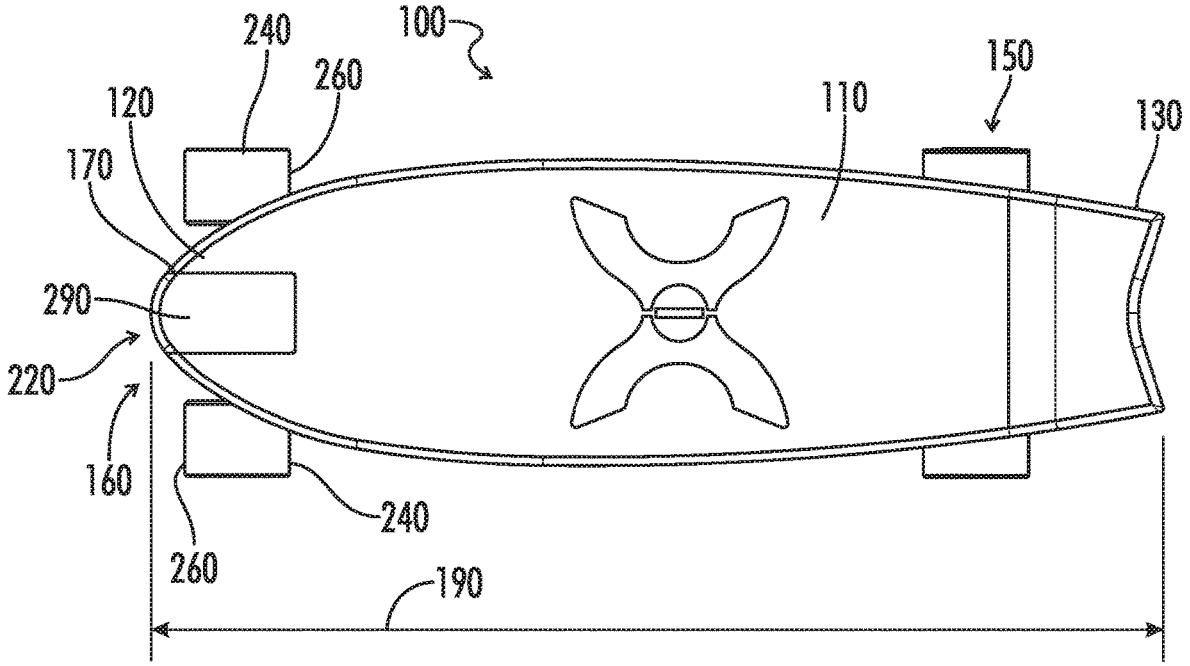
FIGS. 3A and 3B show top views of the sport board system in a skateboard and scooter configuration respectively.
Figure 3B:
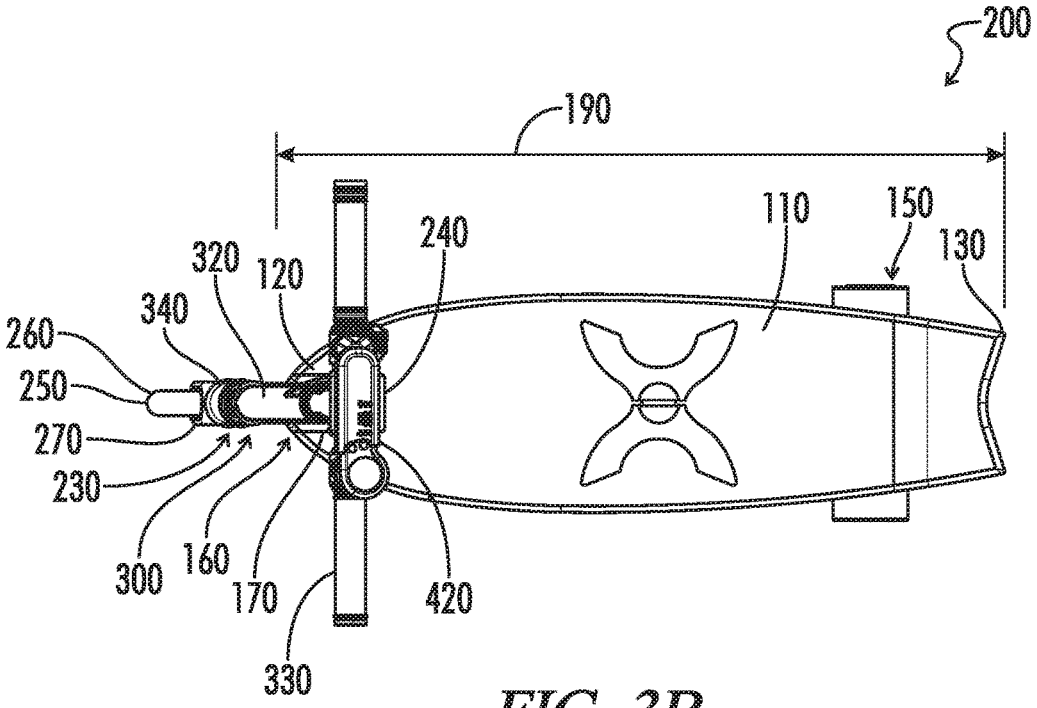
Figure 4A:
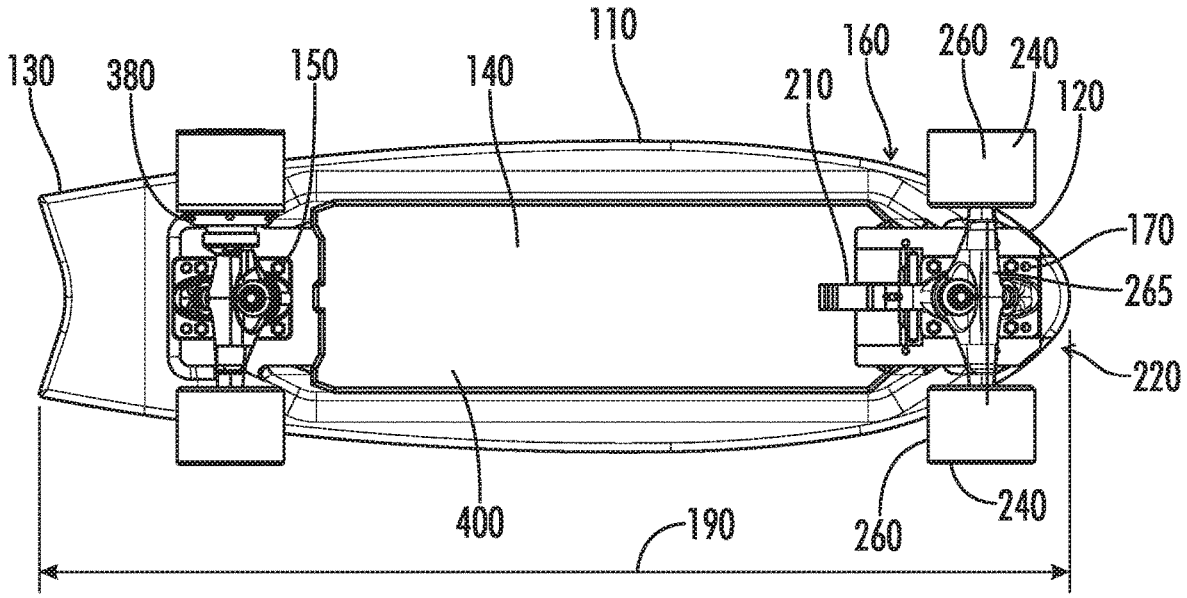
FIGS. 4A and 4B show bottom views of the sport board system in a skateboard and scooter configuration respectively.
Figure 4B:
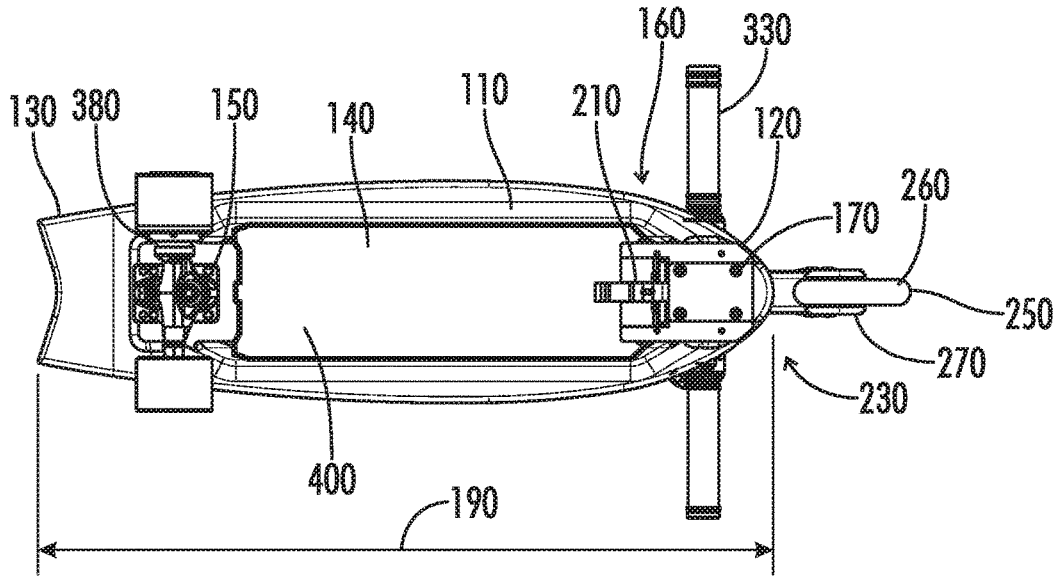
Figure 5A:
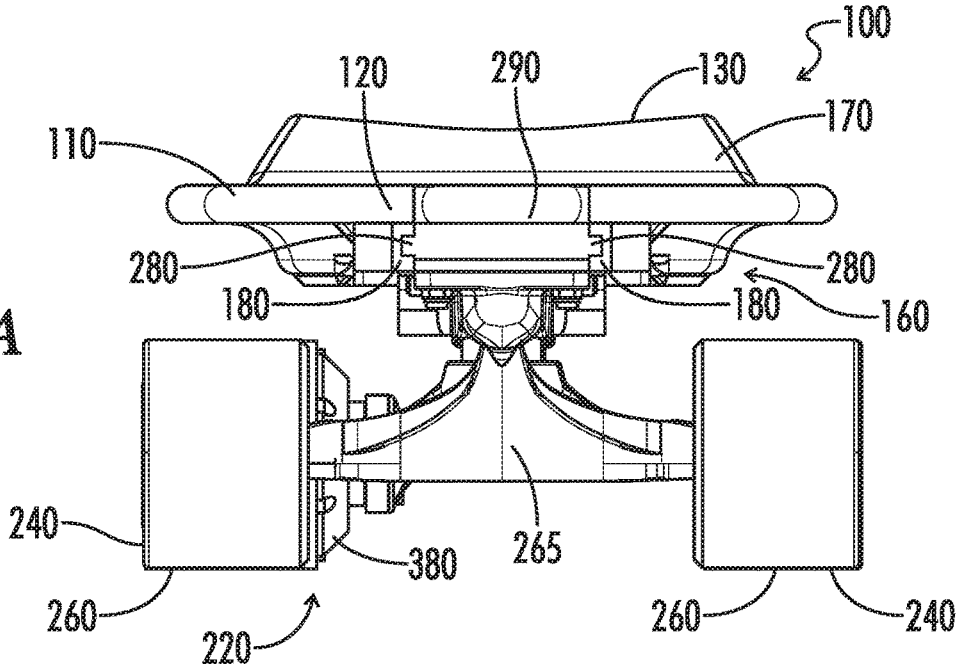
FIGS. 5A and 5B show front views of the sport board system in a skateboard and scooter configuration respectively.
Figure 5B:
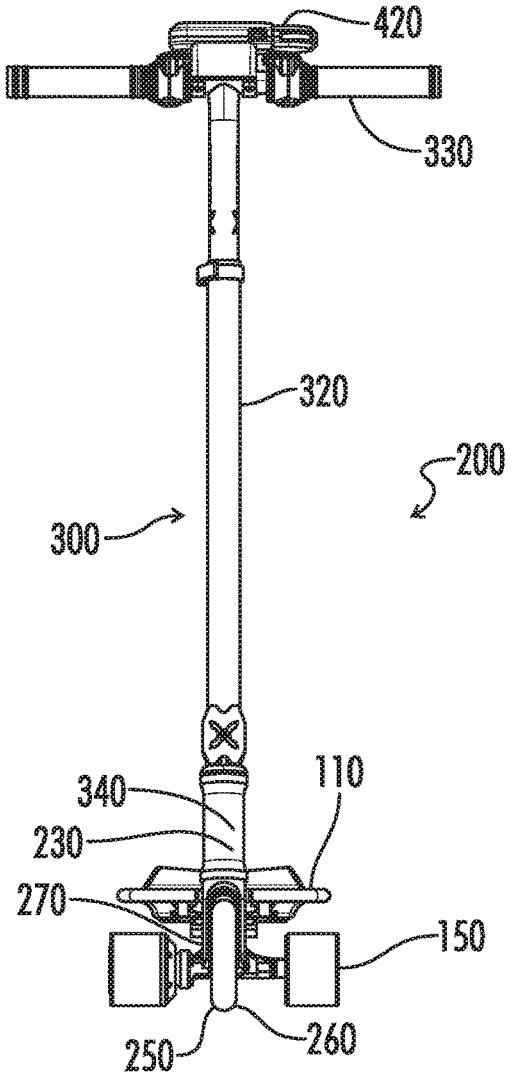

FIGS. 3A and 3B show top views of the sport board system in the skateboard 100 and scooter 200 configurations respectively. FIGS. 4A and 4B show bottom views of the sport board system in the skateboard 100 and scooter 200 configurations respectively. FIGS. 5A and 5B show front views of the sport board system in the skateboard 100 and scooter 200 configuration respectively.

As is visible in FIGS. 4A and 4B, the sport board deck 110 has a bottom surface 140, and a rear wheel assembly 150 is fixed to the bottom surface adjacent the rear end 130. The rear wheel assembly 150 is typically permanently fixed to the sport board deck 110, and the rear wheel assembly therefore provides rear wheels for the sport board system in both the skateboard 100 and scooter 200 configurations.

The sport board system provides a fixation structure 160 for a front wheel assembly at the front end 120 of the sport board deck 110. The fixation structure 160 generally comprises a notch 170 passing through a thickness of the sport board deck 110, fixation rails 180 parallel to a length 190 of the sport board deck, and a locking mechanism 210 at an end of the notch 170.

The sport board system typically comprises a skateboard wheel assembly 220 and a scooter wheel assembly 230, each for mating with the fixation structure 160 independently. Each of the skateboard wheel assembly 220 and the scooter wheel assembly 230 can be, at any given time, the front wheel assembly fixed at the front end 120 of the sport board deck 110 by way of the fixation structure 160. When the skateboard wheel assembly 220 is mated with the fixation structure 160, the sport board assembly is in the skateboard configuration 100 and when the scooter wheel assembly 230 is mated to the fixation structure 160, the sport board assembly is in the scooter configuration 200.

As shown, the skateboard wheel assembly 220 comprises a plurality of skateboard wheels 240, while the scooter wheel assembly 230 typically comprises a single scooter wheel 250. Skateboard wheels 240 typically have a flattened rolling surface 260, while scooter wheels 250 typically have a rounded rolling surface. Accordingly, the skateboard wheels 240 each have a wider rolling surface 260 than the scooter wheel 250.

The skateboard wheel assembly 220 further comprises a wheel truck 265 for retaining the skateboard wheels 240 with the rolling surface substantially parallel with the sport board deck and with a surface that the sport board assembly rolls on. In contrast, the scooter wheel assembly has a fork 270 that retains the single scooter wheel 250.

Each of the skateboard wheel assembly 220 and the scooter wheel assembly 230 comprise mounting rails 280 for mating with the fixation rails 180 of the fixation structure 160 of the sport board deck 110. In some embodiments, the mounting rails 280 may be incorporated into a deck segment 290 shaped to fill the notch 170 of the sport board deck 110 and complete the shape of the sport board deck when mated. Accordingly, the deck segment 290 may have a rounded end that continues the curvature of the front end 120 of the sport board deck 110.

As shown in FIGS. 1A, 1B, 3A, and 4A, when the skateboard wheel assembly 220 is mated with the fixation structure 160 of the sport board deck 110, the plurality of skateboard wheels 240 are located under the length 190 of the sport board deck. Accordingly, when viewed from above, as shown in FIG. 3A the skateboard wheels 240 are between the front end 120 and the rear end 130 of the sport board deck 110. It will be understood that the skateboard wheels 240 may be mounted on the truck 265 such that they are outside of a width of the sport board deck 110, and therefore may not be located directly under the deck.

As shown in FIGS. 2A, 2B, 2B, and 4B, when the scooter wheel assembly 230 is mated with the fixation structure 160, the scooter wheel 250 is located outside of the length 190 of the sport board deck 110. Accordingly, when viewed from above, as shown in FIG. 3B, the scooter wheel 250 is not between the front end 120 and the rear end 130 of the sport board deck 110.

Further, as shown, scooter wheel assembly 230 has a handle assembly 300 that extends upwards above a top surface 310 of the sport board deck 110. As shown, the handle assembly 300 has a column 320 linking a handlebar 330 to the fork 270, and the column 320 and fork 270 may be linked to the deck segment 290 by a bearing 340. The column 320 and handlebar 330 may then be used to steer the sport board system in the scooter configuration 200 by rotating the steering column 320 within the bearing 340, such that the fork 270 retaining the scooter wheel 250 rotates.

In some embodiments, as shown, the bearing 340 is located in front of the front end 120 of the sport board deck 110, such that the column 320 and the fork 270, as well as the scooter wheel 250 are not between the front end 120 and the rear end 130.

In some embodiments, the sport board assembly is motorized, such that the rear wheel assembly 150 is driven by a motor 380, typically an electric motor. In such an embodiment, a battery 400 may be located at the bottom surface 140 of the sport board deck 110. Further, in a motorized version, a first controller 410 may be provided, such as that shown adjacent the skateboard configuration 100 of FIGS. 1A and 1B. Alternatively, distinct controllers may be provided for use in the skateboard configuration 100 and scooter configuration 200.

In some embodiments, the scooter configuration 200 may be provided with a second controller 420 mounted on the handlebar 330. Such a controller may allow for controlling the motor for driving the motor 380 and for operating a braking system for the sport board system. Accordingly, when the system is in the skateboard configuration 100, the first controller 410 may be used and when in the scooter configuration 200, the second controller 420 may be used. Typically, either controller 410, 420, may be used to drive the motor 380 or to operate brakes (not shown). Additional features may be implemented as well and may be controlled from the controller. For example, the controller may link to a smartphone or the like, such that operations of the smartphone may be controlled form the controller.

In some embodiments, the skateboard wheel assembly 220 includes the first controller 410, and when the device is transitioned to a scooter using the scooter wheel assembly 230, the user may insert the first controller 410 into a port in the scooter wheel assembly 230, thereby disabling the first controller and transferring control to the second controller 420. In some embodiments, the first controller 410 is itself mounted on the handlebar 330 of the scooter wheel assembly 230, such that the same controller is used in both configurations.

Figure 6:
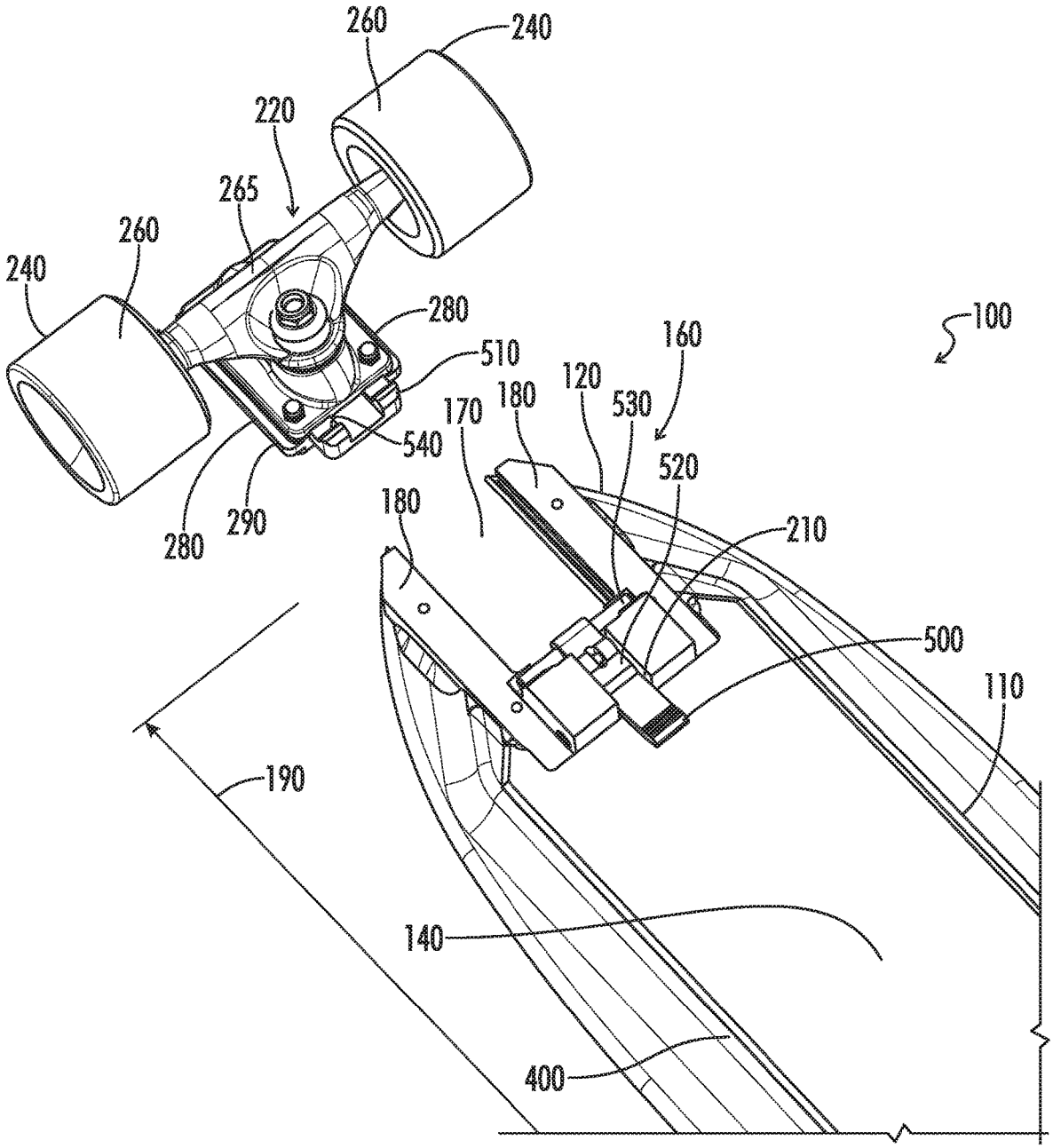
FIG. 6 shows a sport board system with a skateboard wheel assembly removed.
Figure 7A:
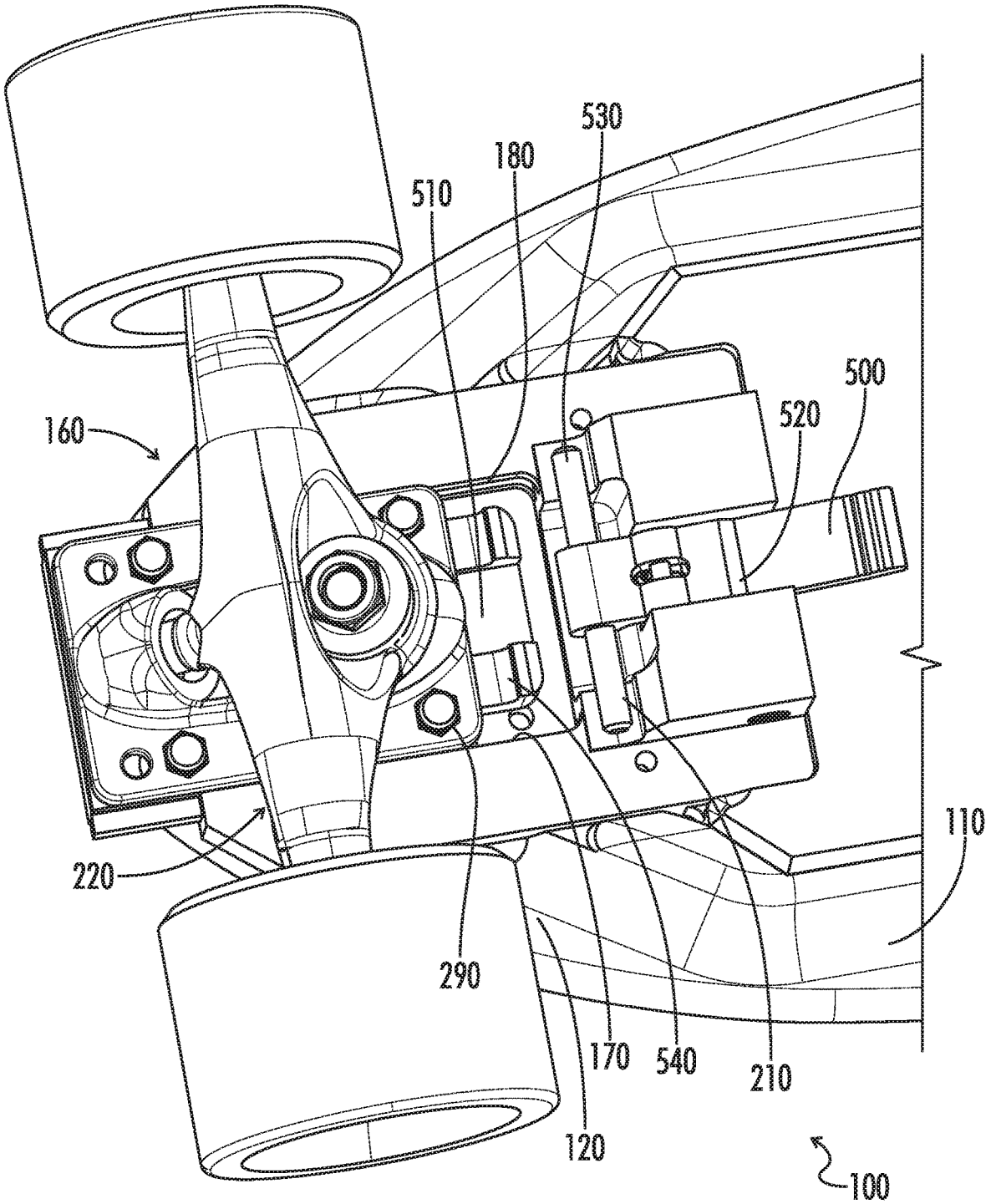
FIG. 7A shows a bottom view of a fixation structure of the sport board system with a skateboard wheel assembly partially removed.
Figure 7B:
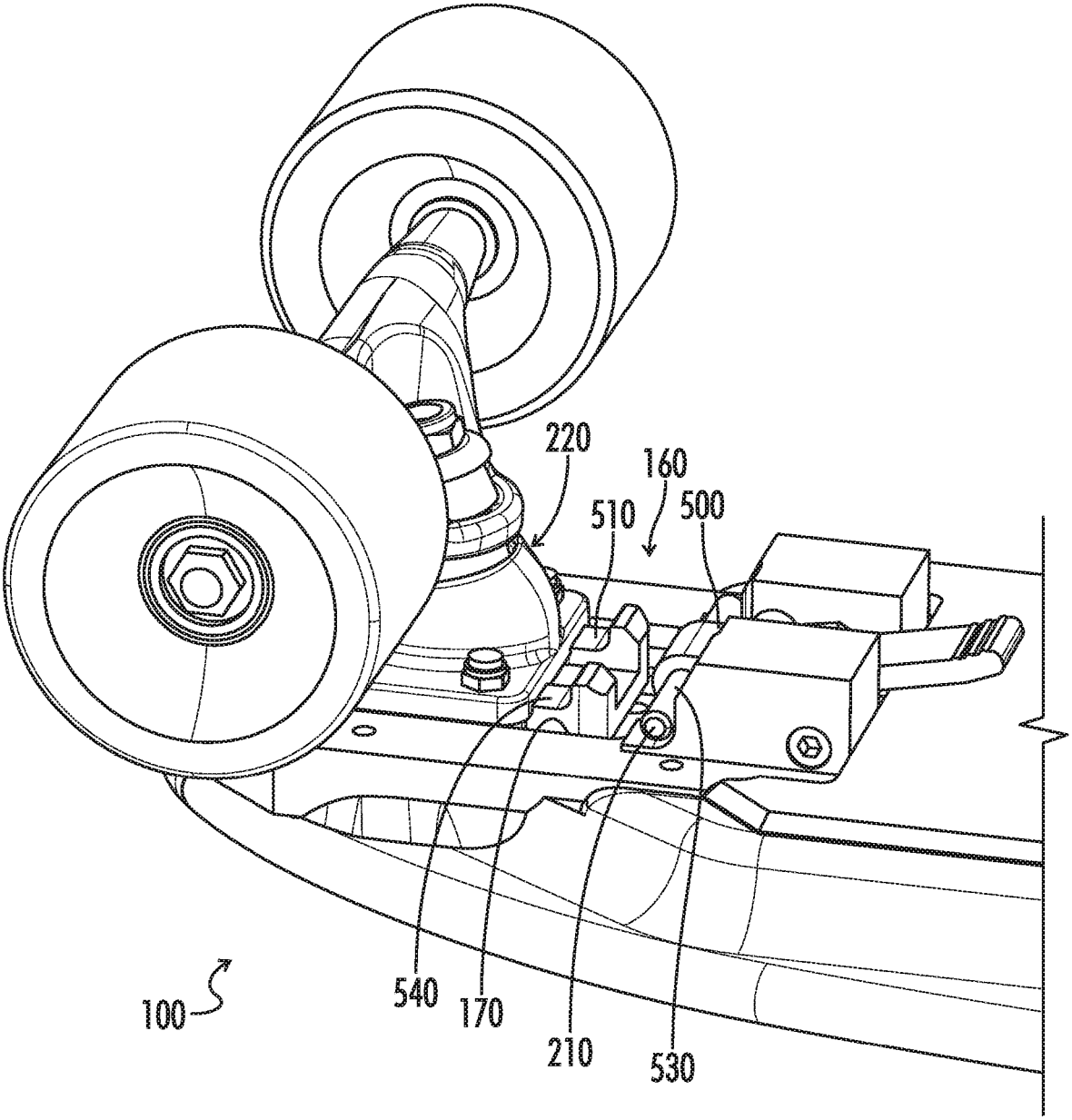
FIG. 7B shows a bottom perspective view of the fixation structure shown in FIG. 7A.
Figure 8:
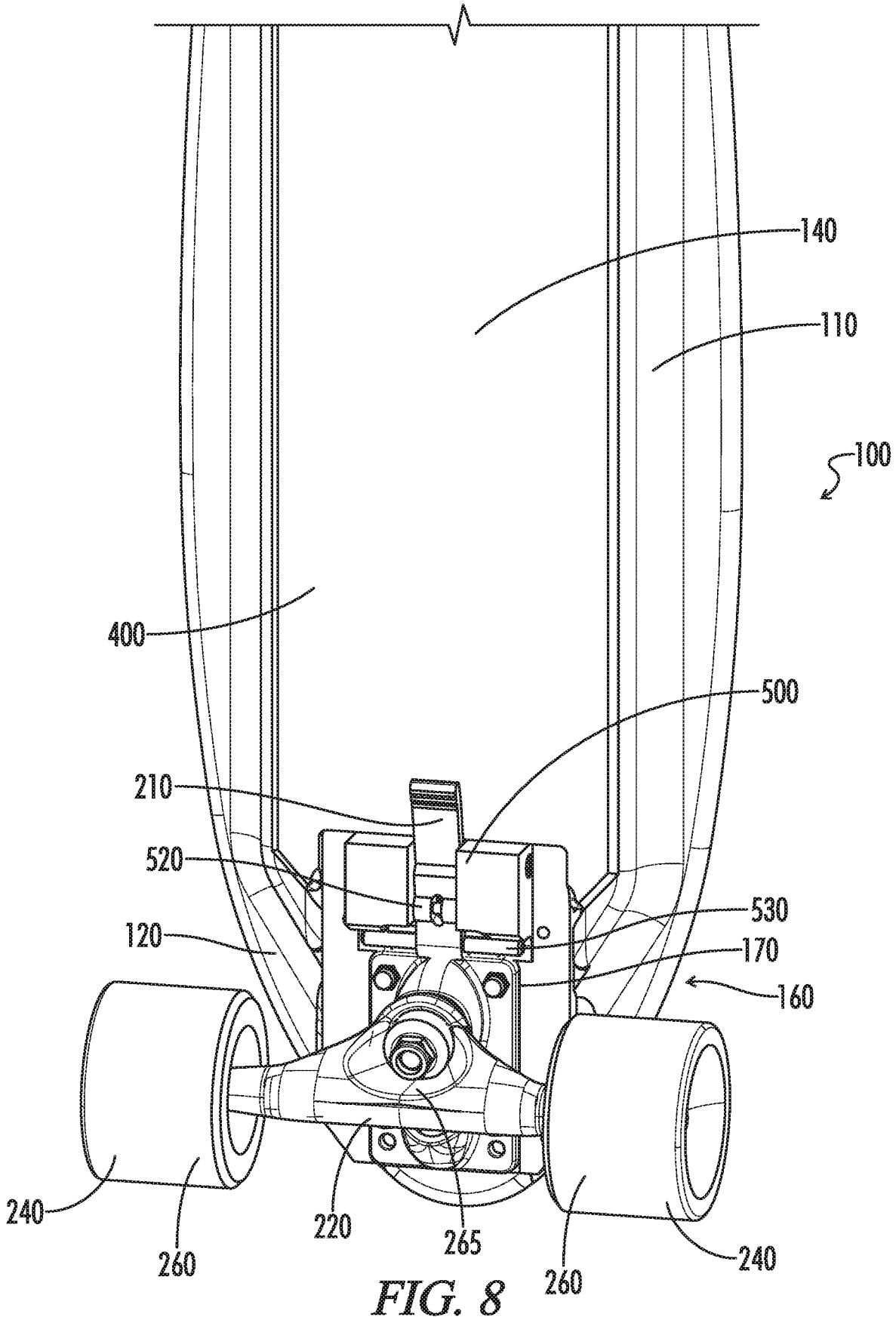
FIG. 8 shows a bottom view of the sport board system in a skateboard configuration.

FIG. 6 shows a sport board system with a skateboard wheel assembly 220 removed, while FIGS. 7A and 7B show bottom views of the fixation structure 160 of the sport board system with the skateboard wheel assembly 220 partially removed. FIG. 8 shows a bottom view of the sport board system in the skateboard configuration 100.

As discussed above, the fixation structure 160 typically comprises a notch 170 passing through the thickness of the sport board deck 110, fixation rails 180 parallel to a length 190 of the sport board deck, and a locking mechanism 210 at an end of the notch.

As shown in FIGS. 6, 7A, 7B, and 8, the locking mechanism 210 may comprise a locking rocker 500 which mates with a receiving structure 510 of the skateboard wheel assembly 220 or the scooter wheel assembly 230. The locking rocker 500 may comprise a rocking element 520 and a bar 530 located at an end of the rocking element. The receiving structure 510 of the skateboard wheel assembly 220 or the scooter wheel assembly 230 may then comprise a notch 540 for receiving the bar 530.

Typically, in order to mate the skateboard wheel assembly 220 or scooter wheel assembly 230 with the sport board deck 110, the rails 280 of the wheel assembly are mated with the corresponding fixation rails 180 of the fixation structure 160. The wheel assembly is then slid along the fixation rails 180 until the receiving structure 510 is adjacent the locking mechanism 210.

It will be understood that while a bar 530 and notch 540 are shown, various locking mechanisms may be substituted, so long as the locking mechanism retains the corresponding assembly 220, 230 at the end of the notch 170.

Also provided is a novel and quick way to convert a skateboard into a scooter and back again. The conversion process involves the hinged rocking element 520 which is located on one end of the sport board deck 110 and which allows for the removal of a skateboard wheel assembly 220. The handlebar (with accelerator and braking controls) incorporated into a scooter wheel assembly 230 is then inserted into the notch 170 where the skateboard wheel assembly 220 was and is locked into place using the rocking element 520, thus completing the conversion from skateboard to scooter.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A sport board system comprising:

a sport board deck having a bottom surface, a front end, and a rear end;

a rear wheel assembly fixed to the bottom surface adjacent the rear end;

a fixation structure for a wheel assembly at the front end, the fixation structure comprising:

a notch passing through a thickness of the sport board deck;

fixation rails parallel to a length of the sport board deck; and a locking mechanism at an end of the notch, wherein the locking mechanism is a locking rocker which mates with a receiving structure of each of a skateboard wheel assembly and a scooter wheel assembly.

2. The sport board system of claim 1, wherein the skateboard wheel assembly comprises a plurality of skateboard wheels; and the scooter wheel assembly comprises at least one scooter wheel and a handle assembly, wherein, when the scooter wheel assembly is mated with the fixation structure, the at least one wheel extends downwards from the bottom surface of the sport board deck and the handle assembly extends upwards above a top surface of the sport board deck.

3. The sport board system of claim 2, wherein each of the skateboard wheel assembly and the scooter wheel assembly comprise a mounting rail for mating with the fixation rail of the fixation structure.

4. The sport board system of claim 3, wherein each of the scooter wheel assembly and the skateboard wheel assembly comprise a deck segment containing the mounting rail, and wherein the deck segment is shaped to complete the shape of the sport board deck when mated with the sport board deck.

5. The sport board system of claim 2, wherein the length of the sport board deck is defined from the front end to the rear end, and wherein when the skateboard wheel assembly is mated with the fixation structure, the plurality of skateboard wheels are located under the length of the sport board deck.

6. The sport board system of claim 5, wherein when the scooter wheel assembly is mated with the fixation structure, the at least one wheel is a single wheel located outside the length of the sport board deck.

7. The sport board system of claim 6, wherein the handle assembly extends upwards from the scooter wheel assembly outside the length of the sport board deck.

8. The sport board system of claim 7, wherein the rear wheel assembly is motorized, and wherein the handle assembly comprises a controller for controlling a motor for driving the rear wheel assembly.

9. The sport board system of claim 8, wherein the controller further controls a braking assembly for braking the sport board system.

10. The sport board system of claim 2, wherein the skateboard wheel assembly further comprises a wireless controller for controlling a motor for driving the rear wheel assembly.

11. The sport board system of claim 2, wherein the skateboard wheels each have a wider rolling surface than the at least one scooter wheel.

12. The sport board system of claim 1, wherein the locking rocker comprises a bar and wherein the receiving structure of each of the skateboard wheel assembly and the scooter wheel assembly comprises a notch for receiving the bar.

13. The sport board system of claim 1, wherein the rear wheel assembly is motorized, and wherein a battery is located at the bottom surface of the sport board deck.

14. A sport board system comprising:

a sport board deck having a bottom surface, a front end, and a rear end;

a rear wheel assembly fixed to the bottom surface adjacent the rear end;

a fixation structure for a wheel assembly at the front end, a skateboard wheel assembly for mating with the fixation structure, the skateboard wheel assembly comprising a plurality of skateboard wheels; and a scooter wheel assembly for mating with the fixation structure, the scooter wheel assembly comprising at least one scooter wheel and a handle assembly, wherein the fixation structure comprises:

a notch passing through a thickness of the sport board deck;

fixation rails parallel to a length of the sport board deck; and a locking mechanism at an end of the notch, wherein, when the scooter wheel assembly is mated with the fixation structure, the at least one wheel extends downwards from the bottom surface of the sport board deck and the handle assembly extends upwards above a top surface of the sport board deck, wherein each of the skateboard wheel assembly and the scooter wheel assembly comprise a mounting rail for mating with the fixation rail of the fixation structure, and wherein each of the scooter wheel assembly and the skateboard wheel assembly comprise a deck segment containing the mounting rail, and wherein the deck segment is shaped to complete the shape of the sport board deck when mated with the sport board deck.

* * * * *